United States Patent [19]

Morroll et al.

[11] 4,456,908

[45] Jun. 26, 1984

[54] REMOTE SWITCH MONITORING CIRCUIT FOR MINING

[75] Inventors: Terence D. Morroll, Beeston; David A. Straw, Sandiacre, both of England

[73] Assignee: Plessey Overseas Limited, Ilford, England

[21] Appl. No.: 525,267

[22] Filed: Aug. 22, 1983

Related U.S. Application Data

[63] Continuation of Ser. No. 248,708, Mar. 30, 1981, abandoned.

[30] Foreign Application Priority Data

Mar. 28, 1980 [GB] United Kingdom ..... 8010536

[51] Int. Cl.[3] ..... G08B 21/00

[52] U.S. Cl. ..... 340/644; 340/650; 340/652; 340/659

[58] Field of Search ..... 340/644, 658, 638, 659, 340/505, 506, 510, 511, 512, 513, 650, 651, 652

[56] References Cited

U.S. PATENT DOCUMENTS 3,611,361 10/1971 Gallichotte et al. ..... 340/512
3,713,142 1/1973 Getchell ..... 340/505
4,044,351 8/1977 Everson ..... 340/505
4,266,219 5/1981 Foster et al. ..... 340/506

*Primary Examiner*—John W. Caldwell, Sr.
*Assistant Examiner*—Daniel Myer
*Attorney, Agent, or Firm*—Fleit, Jacobson, Cohn & Price

[57] ABSTRACT

In a monitoring system for the gates of a mine lift shaft, each gate has a switch and a square wave is generated in a signal station and connected to a transistor inverter beyond each switch. When the switch is in the closed (safe) position, the transistor inverter is connected in circuit and the inverse of the waveform is transmitted back to the signal station. When the switch opens the transistor is shorted out and thus the returned waveform is in phase with the transmitted waveform. The various conditions which may be received at the signal station are detected and only if the switch and cable are operating correctly is the gate closed condition indicated. The use of a square wave and a changeover switch ensure that both conditions of the switch produce a definite signal at the signal station, thus any failure in the cable or switch prevents the received waveform from being the inverse of the transmitted waveform. This is detected by the signal station as an unsafe condition and if it is due to a fault this is also indicated.

8 Claims, 2 Drawing Figures

REMOTE SWITCH MONITORING CIRCUIT FOR MINING

Figures 1, 2:
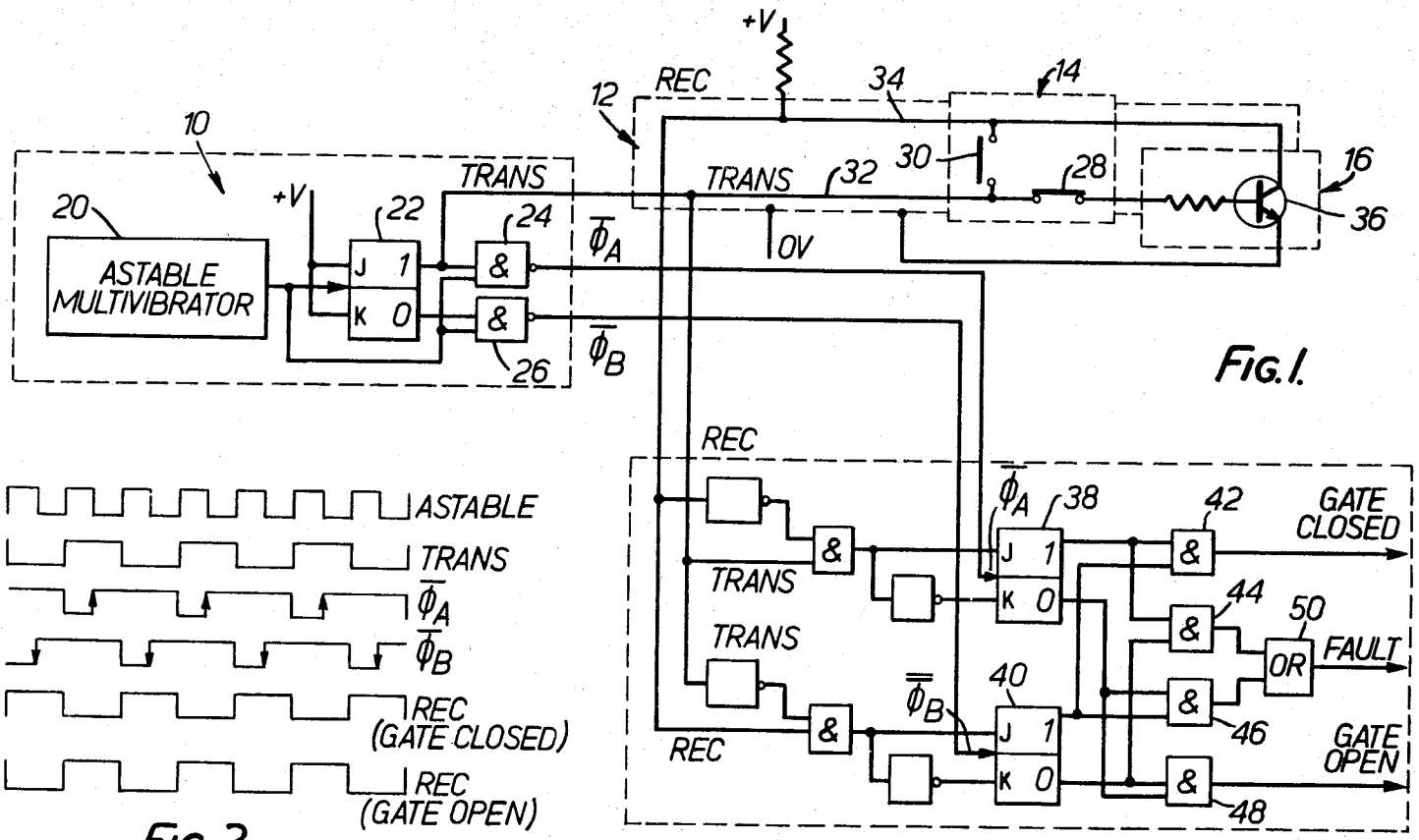

This application is a continuation of abandoned application Ser. No. 248,708, filed Mar. 30, 1981.

This invention relates to monitoring systems for monitoring the condition of remotely located objects such as, for example, the gates and other equipment adjacent to the cage in a mine shaft.

It is clearly desirable that the condition of the gates in a mine shaft (whether open or closed) is known before the winding mechanism of the cage is operated, and to achieve this switches of various types (limit switches, proximity switches, etc.) are normally fitted to operate when the gates are fully closed and other obstructions are completely clear of the shaft. These switches are connected to a signal station at the shaft side via cables which, because of the hazardous environment, may be subject to open and short circuits.

The object of the system is to lock the brakes to prevent movement of the cage if any equipment is in a dangerous position and it is therefore essential that any failure either in the switches or the cables connecting them to the signal station should be detected immediately and should also result in locking the brakes in the on position.

A known method of monitoring a switch and a cable is to use an A.C. waveform with a remote diode connected across the cable beyond the switch and use the resulting half-wave rectified voltage to operate a relay. However this circuit requires a high current to operate successfully, and can only be economically employed if several switches are connected in series with the diode at the remote end of the switches.

It is now a requirement that the switches are monitored individually, thus necessitating a circuit for each switch, and it is an object of the present invention to provide such a circuit which does not need a high current and is economical to operate.

According to the present invention a monitoring system for monitoring the condition of one or more remotely located objects comprises means for generating a signal having a predetermined waveform, means for each object for receiving the signal and, according to the condition of the object, retransmitting it with the same or a revised waveform, means for detecting the waveform shape of the retransmitted signal and means for indicating the condition of the object or the system depending upon the waveform shape of the retransmitted signal.

Thus the object can have a number of required conditions and a predetermined retransmitted waveform shape indicates which condition the object is in. A retransmitted waveform which does not match that of a required condition of the object is used to indicate a fault in the system.

Preferably the generated signal has a square waveform. Preferably each object has two required positions and the means for receiving and retransmitting the signal for each object retransmits a different waveform for each condition of the object.

Preferably the two retransmitted waveforms are the same as the generated waveform and the inverse of the generated waveform.

Preferably the means for receiving the signal and retransmitting it comprises a switch having two positions: one in which an inverter is connected into circuit and one in which the inverter is shorted out and the retransmitted waveform is in phase with the generated waveform.

The means for detecting the waveform shape of the retransmitted signal may comprise comparison means which compares the phases of the generated waveform and the retransmitted waveform.

The comparison means preferably comprises two parallel circuits each comprising an inverter, an AND gate and a bistable.

The remotely located objects may comprise mine gates and/or other equipment adjacent to the cage in a mine shaft.

An embodiment of the invention will now be described by way of example only with reference to the accompanying drawings in which, FIG. 1 is a circuit diagram of a monitoring system according to the invention for a remotely located mine gate in a mine shaft and, FIG. 2 is an illustration of the waveforms transmitted and received in the system.

The system comprises basically a waveform generator 10 which is adapted to transmit a signal along a screened cable 12 to a mine gate switch 14, an inverter 16 connected beyond the mine gate switch 14 and a signal station 18. The cable 12, the gate switch 14 and the inverter 16 are mounted underground and the signal station 18 may also be mounted underground.

The waveform generator 10 comprises an astable multivibrator 20, a bistable 22 and two NAND gates 24 and 26. The waveform generator generates a transmission signal having a square waveform shape B as shown in FIG. 2 from the waveform A emitted by the astable multivibrator 20. Also generated are two clock pulse signals $\overline{\phi}_A$ and $\overline{\phi}_B$ which are fed to the signal station 18, the clock pulse signal $\overline{\phi}_A$ having a waveform shape C and the clock pulse signal $\overline{\phi}_B$ having a waveform shape D as shown in FIG. 2.

The transmission signal is fed along the conductor 32 in the screened cable 12 to the mine gate switch 14 and is also fed to the signal generator 18. The switch 14 comprises two ganged contacts 28 and 30, the contact 28 being adapted to connect the conductor 28 to the inverter 16, and the contact 30 being adapted to connect the conductor 28 to a return conductor 34, also contained within the screened cable 12. In the "mine gate closed" position as shown in FIG. 1 the contact 28 is closed and the contact 30 is open and in the "mine gate open" position the contact 28 is open and the contact 30 closed. The switch is connected by suitable means to be operated by the mine gate (not shown).

The inverter comprises a transistor 36 and the conductor 32 is adapted to be connected to the base of the transistor by the contact 28. A power supply V is fed to the collector of the transistor via the return conductor 34, and the emitter is connected to the screen (or earth) of the screened cable 12.

Thus when the switch is in the "mine gate closed" position as shown in FIG. 1, the transmission signal is fed directly to the base of the transistor 36. The square waveform of the transmitted signal produces a similar, but inverted waveform (E in FIG. 2) to pass through the transistor 36, and this signal is returned along the conductor 34 to the signal station 18.

The signal station 18 comprises essentially two bistables 38 and 40 which are supplied with the clock pulses $\overline{\phi}_A$ and $\overline{\phi}_B$ respectively, and the bistables effectively compare the transmission signal and the returned signal.

The outputs from the bistables 38 and 40 are connected in such a manner to four AND gates 42, 44, 46 and 48 that when the return signal is inverted (mine gate closed) a signal is only produced from the AND gate 42 and this can be used to energise a suitable indicating device to indicate that the mine gate is closed and the mine cage can be moved.

When the mine gate is open, the contact 30 is closed and the contact 28 is open and the transmission signal thus by-passes the inverter 16 and the returned signal has the same waveform as the transmission signal (as F in FIG. 2). This is detected by the bistables 38 and 40 and a signal is produced from the AND gate 48. Again this can be used to indicate that the mine gate is open and can also be used via suitable transducer means (not shown) to lock the brakes of the mine cage mechanism. If the system indicates that the mine gate is open when it should be closed the signal can be used to sound an alarm if the brakes are not applied, and if they are applied they can be locked on.

If a fault occurs in the system such as a short or open circuit in one of the conductors 32 and 34, the signal station will not receive either two similar waveforms or two waveforms one of which is inverted. For example no signal may be received or a continuous signal may be received. In this case one of the AND gates 44 and 46 will produce a signal and the OR gate 50 will produce a signal to indicate a fault in the system.

Thus by using a square wave and a changeover switch 14 such that both conditions of the switch produce a definite signal at the signal station 18 any failure in the cable 12 or the switch 14 prevents the returned signal from being the inverse of the transmission signal. This is detected by the signal station 18 as an unsafe condition, and if it is due to a fault in the system, this is also indicated.

Whilst the invention has been described in connection with the gate of a mine cage it will be appreciated that the invention can be used for indicating the condition of various other remotely located objects, for example, doors, windows or other objects in a building or as a security system.

What is claimed is:

1. A monitoring system for a gate remotely located from said monitoring system in a mine for indicating whether said gate is closed, open, or whether a fault exist in the monitoring system, said system comprising:

signalling means for generating a signal;

electrical circuit means and receiving means for conducting and receiving, respectively, electrical signals;

said signalling means generating a signal having a predetermined wave form and transmitting said signal to said electrical circuit means and to said receiving means, said electrical circuit means conducting said signal to said gate and conducting return signals from said gate to said receiving means;

said electrical circuit means also including signal inverting means for inverting said signal and switching means for routing said signal over respective paths;

said inverting means, when energized, producing a first return signal from said gate which is the inverse of said signal received by said gate;

said switching means energizing said inverter when said gate is closed and deenergizing said inverter when said gate is open and producing a second return signal from said gate being the same as said signal from said electrical circuit means when said inverter is deenergized;

said receiving means comprising comparator means and indicating means for respectively comparing said signal and indicating the status of said mine gate and monitoring system;

said comparator means comparing said signal transmitted from said signalling means with said return signals conducted from said electrical circuit means; and said indicating means indicating when said gate is closed and open when said first and second return signals are received, respectively, and also indicating a fault in said monitoring system when a return signal is not one of said first and second return signals.

2. A monitoring system as claimed in claim 1 in which the signalling means generates a square waveform.

3. A monitoring system as claimed in claim 1 or 2 in which each object has two conditions and the means for retransmitting the signal associated with each object further includes means for retransmitting distinguishable waveforms for each condition of the object.

4. A monitoring system as claimed in claim 3 in which the two retransmitted waveforms comprise the generated waveform and the inverse of the generated waveform.

5. A monitoring system as claimed in claim 4 in which the means for receiving and retransmitting the signal comprises a switch having two positions: one in which an inverter is connected in the circuit path between the signalling means and the retransmitting means when the object resides in a first condition thereby to retransmit an inversion of the signal, and the other in which a short circuit is placed between the signalling means and the retransmitting means thereby to retransmit the signal in phase with the generated signal.

6. A monitoring system as claimed in claim 1 in which the means for detecting the waveform shape of the retransmitted signal comprises comparison means which compares the phases of the generated waveform and the retransmitted waveform.

7. A monitoring system as claimed in claim 6 in which the comparison means comprises two parallel circuits each comprising an inverter, an AND gate and a flip-flop.

8. A monitoring system as claimed in claim 1 in which the remotely located objects comprise mine gates having an open condition and a closed condition in a mine shaft.

* * * * *